US006092933A

United States Patent [19]

Treu

[11] Patent Number: 6,092,933

[45] **Date of Patent: *Jul. 25, 2000**

[54] STABLE-FREE-STANDING BAG OF HEAT SEALABLE OR WELDABLE PLASTIC FOIL

[75] Inventor: Wolfgang Treu, Wiesloch, Germany

[73] Assignee: SPS Verpackungssystem GmbH, Dresden, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/765,116

[22] PCT Filed: Jan. 9, 1995

[86] PCT No.: PCT/EP95/00057

§ 371 Date: Apr. 16, 1997

§ 102(e) Date: Apr. 16, 1997

[87] PCT Pub. No.: WO95/33663

PCT Pub. Date: Dec. 14, 1995

[30] Foreign Application Priority Data

Jun. 8, 1994 [DE] Germany ..... 94 09 316 U

[51] Int. Cl.[7] ..... B65D 30/16; B65D 33/36

[52] U.S. Cl. ..... 383/104; 383/96; 383/107; 383/122; 383/906

[58] Field of Search ..... 383/42, 80, 81, 383/104, 93–96, 906, 120, 122, 33, 35, 36, 44, 88, 89, 66, 67, 105, 107, 904, 907

[56] References Cited

U.S. PATENT DOCUMENTS

| | | | |
|---|---|---|---|
| 3,063,614 | 11/1962 | Orsini | 383/907 X |
| 3,367,380 | 2/1968 | Dickey | 383/906 X |
| 3,380,646 | 4/1968 | Doyen et al. . | |
| 3,935,993 | 2/1976 | Doyen et al. . | |
| 4,732,299 | 3/1988 | Hoyt . | |
| 5,356,069 | 10/1994 | Bochet et al. | 383/104 X |

FOREIGN PATENT DOCUMENTS

| | | | |
|---|---|---|---|
| 052 151 | 2/1985 | European Pat. Off. . | |
| 19 21 349 | 11/1970 | Germany . | |
| 31 19 179 | 12/1981 | Germany . | |
| 39 25 981 | 2/1991 | Germany . | |
| 41-6065 | 3/1966 | Japan . | |
| 51-31215 | 6/1977 | Japan . | |
| 58-180135 | 12/1983 | Japan . | |
| 59-83747 | 6/1984 | Japan . | |
| 60-68034 | 5/1985 | Japan . | |
| 4006044 | 1/1992 | Japan | 383/104 |
| 823855 | 12/1959 | United Kingdom . | |

*Primary Examiner*—Jes F. Pascua
*Attorney, Agent, or Firm*—Tilton, Fallon, Lungmus & Chestnut

[57] ABSTRACT

A free-standing bag made of a heat-sealable or weldable plastic material and used for receiving therein liquids and/or pastes, said bag comprising two side walls connected to each other along their longitudinal edges, a foldable bottom element, which is disposed between said side walls and which serves as a supporting base, being inserted between the bottom transverse edges, whereas in the area of the other ends of said side walls a foldable lid element, which is disposed between said side walls, is inserted, and further comprising a discharge opening. In order to improve the handling characteristics of the free-standing bag when the contents are being poured out and in order to ensure also ease of manufacture, the discharge opening is formed between the upper transverse edge of a side wall and the complementary edge of the lid element.

5 Claims, 2 Drawing Sheets

STABLE-FREE-STANDING BAG OF HEAT SEALABLE OR WELDABLE PLASTIC FOIL

FIELD OF THE INVENTION

The present invention refers to a free-standing bag made of a heat-sealable or weldable plastic foil and used for receiving therein liquids and/or pastes, said bag comprising two side walls connected to each other along their longitudinal edges, a foldable bottom element, which is disposed between said side walls and which serves as a supporting base, being inserted between the bottom transverse edges, whereas in the area of the other ends of said side walls a foldable lid element, which is disposed between said side walls, is inserted, and further comprising a discharge opening.

BACKGROUND OF THE INVENTION

Free-standing bags made of plastic foils are known in particular as throw-away packings for beverages, but also for washing powder or the like. Free-standing bags according to the generic clause are described e.g. in German Utility Model G 89 00 883 and also in German Utility Model G 89 00 882. The bottom of such bags is provided with a supporting base so that the bag can be placed on a surface also in its open state, without the contents of the bag flowing out through the discharge opening formed in the upper area and without the bag tilting over. Furthermore, in order to increase the stability, an additional lid element, whose structural design is similar to that of the supporting base, is incorporated between the side walls in the upper part of such bags so that, when filled, bags of this type have a cylinder-like shape.

A fundamental advantage of such free-standing bags is to be seen in the fact that, as long as they have not been filled, they can be folded very tightly and that, consequently, they require only very little space. When filled, they have, however, a comparatively high inherent stability and are thus particularly suitable for use as refillable packings for the media which have already been mentioned hereinbefore.

In the case of the known bags, the discharge opening is realized either in the area of the lid element (German Utility Model 89 00 883) or in the upper part of a side wall (German Utility Model 89 00 882).

In the first case, the discharge opening lies centrally in the middle of the free-standing bag and projects like a pouring spout; however, due to its flexibility, said spout does not always permit a stable discharge of the medium during pouring out, in particular when the medium is being refilled into bottles, so that there is the risk of spilling.

In the second case, i.e. when the discharge opening is formed in the side wall, the free-standing bag must be brought up to the vessel to be filled from the side for transferring the contents of said bag into said vessel, and this may cause problems as well.

It is the object of the present invention to improve the handling characteristics of a free-standing bag of the type mentioned at the beginning when the contents are being poured out and to ensure also greater ease of manufacture.

SUMMARY OF THE INVENTION

According to the present invention, this object is achieved by the feature that the discharge opening is formed between the upper transverse edge of a side wall and the complementary edge of the lid element. It follows that a stable discharge of the substance contained in the bag can be guaranteed because said substance can flow along the side wall until it reaches the discharge opening without being rerouted. In addition, the free-standing bag according to the present invention can be produced easily and at a moderate price, since it suffices to leave open part of the welding seam between the upper transverse edge of a side wall and the complementary edge of the lid element.

In accordance with a preferred embodiment, the discharge opening is defined by a side wall flap, formed on a side wall and projecting beyond a transverse edge of said side wall, and a lid element flap formed on the lid element in a corresponding manner, said side wall flap and said lid element flap being interconnected along their longitudinal edges.

On the basis of this solution, the discharge opening is defined by two flaps, one flap being part of the side wall, whereas the other flap is part of the lid element. By means of connecting the longitudinal edges, a discharge opening is thus formed, and the medium to be discharged can again flow freely along the side wall up to the end in the area of the opening, i.e. it is not rerouted. This results in a "smooth" uniform discharge flow so that even small amounts can be transferred precisely without any risk of spilling. In addition, the production is very simple because, when the individual foil components are being prepared, it suffices to cut out a protruding portion on the side wall for forming the side wall flap and a complementary protruding portion on the lid element.

In accordance with an advantageous further development of the present invention, a screw plug element is inserted in the discharge opening. By means of this measure, the discharge opening can be closed easily, if, for example, only part of the content of the free-standing bag has been transferred to some other receptacle or discharged.

A further embodiment of the present invention discloses that, on the sides of of the discharge opening, the corner areas of the side wall at which said discharge opening is formed are interfacially connected to the associated corner areas of the lid element in a triangular shape up to the point where the longitudinal edges of the discharge opening begin. This has the effect that, during pouring out, the liquid to be discharged is laterally supplied to the discharge opening, and, especially when the media to be discharged are liquid media, this will result in a smooth discharge flow.

In accordance with a further advantageous embodiment, an opening for filling the bag is provided in the area of the bottom between one side of the bottom element and a lower transverse edge of a side wall. In the case of this embodiment, corresponding bottom flaps can be provided in the area of the bottom on one side of the bottom element and on the lower transverse edge of the side wall, said bottom flaps being interconnected along their longitudinal edges and defining the opening for filling the bag. This solution provides, in addition to the discharge opening, a separate opening for filling the bag, said opening being closed after the filling operation by interconnecting the corresponding flaps by means of heat-sealing carried out e.g. from the bottom. The contents are then discharged through the discharge opening. If a separate opening for filling the bag is not provided, the discharge opening is also used for filling the bag.

A further advantageous embodiment of the present invention shows the feature that the side walls are provided with outwardly directed longitudinal embossings which extend in spaced relationship with each other between the transverse edges.

These longitudinal embossings define longitudinal folding lines that are embossed in the foil material. In the filled state of the bag, a polygonal shape (when seen in a horizontal section) of the filled receptacle, i.e. a configuration deviating from the round shape, will be obtained, depending on the number of longitudinal embossings. If, for example, two such longitudinal embossings are arranged in spaced relationship with each other in each side wall, the resultant free-standing bag will have a hexagonal shape in the filled state so that the receptacles can be juxtaposed closely for the purpose of transport or for the purpose of presentation in shops so that there will be less dead space between said receptacles than in the case of abutting receptacles having a round cross-section.

Another further development of the present invention shows the features that the side wall flap and the lid element flap have an essentially rectangular shape, and that, finally, the outer contour of the bag defines a square whose edges are between 10 and 15 cm long.

Bags of this type are very convenient to handle and they are suitable for a great variety of different applications.

In the following, the present invention will be explained in detail on the basis of the drawing, in which:

DETAILED DESCRIPTION OF THE PREFERRED EMBODIMENTS

Figure 1:
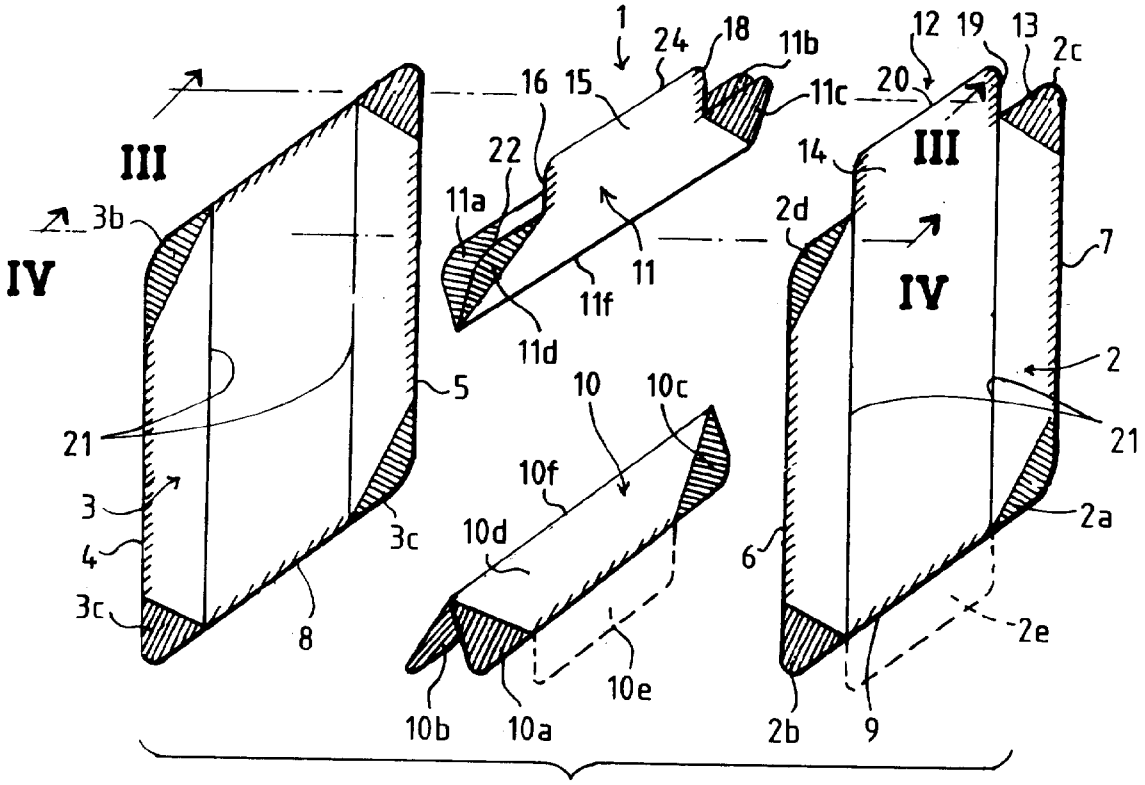
FIG. 1 shows a perspective exploded view of the component parts of a first embodiment of a free-standing bag according to the present invention.

In FIG. 1, the individual components of a first embodiment of the free-standing bag according to the present invention are shown. These parts are preferably formed of a composite structure of two foil materials in a manner which is known per se.

The free-standing bag according to the present invention comprises a side wall 2, a side wall 3, a bottom element 10 that serves as a supporting base, and a lid element 11.

In the connected condition of the bag, the bottom element and the lid element lie within the contour of the side walls. These parts then unfold in an appropriate manner when the receptacle is being filled.

The lid element 11 has integrally formed thereon a lid element flap 15 in accordance with the present invention. Also the side wall 2 has integrally formed thereon the side wall flap 14 in a manner corresponding to the lid element flap 15. The individual parts are now interconnected for producing the bag. In so doing, the longitudinal edges 4 and 5 of side wall 3 are sealed with the longitudinal edges 6 and 7 of side wall 2 along the hatched sections. The corner areas 3*a*, 3*b*, 3*c* and 3*d* of side wall 3 are interfacially connected to the corner areas 11*a*, 11*b*, 10*b* and the rear corner of the bottom element in a triangular shape, said rear corner of the bottom element being not shown in the drawing.

The corner areas 11*d*, 11*c*, 10*a* and 10*c* are—in accordance with this sequence—heat-sealed with the corner areas 2*d*, 2*c*, 2*b* and 2*a* of side wall 2, again in a triangular shape.

The respective edges of the bottom element and of the lid element pointing sidewards are heat-sealed with the longitudinal edges 4, 6 and 5, 7, again in the longitudinal direction.

Finally, the lower edge 8 is connected to the bottom element edge associated therewith, whereas the lower edge of the bottom element 10, which faces the side wall 2, is heat-sealed with the lower edge 9 of said side wall.

The lid element is heat-sealed along its upper edge, which faces side wall 3, with the complementary upper edge of said side wall, whereas the lid element flap 15 is heat-sealed with the complementary longitudinal edges 17 and 19 of the side wall flap 14 only along the longitudinal edges 16 and 18 thereof.

In accordance with one variation of the free-standing bag according to the present invention, which is also outlined in FIG. 1 by means of broken lines, the lower side of the side wall 2 and the surface of the bottom element 10 facing said lower side of the side wall can have arranged thereon bottom flaps 2*e* and 10*e*, respectively, corresponding to the side wall and lid element flaps 14 and 15. These flaps can again be interconnected along their longitudinal edges in such a way that an opening for filling the bag is formed in this area; after the filling operation, said opening can be heat-sealed interfacially or along the edges so as to close the bag.

Figure 2:
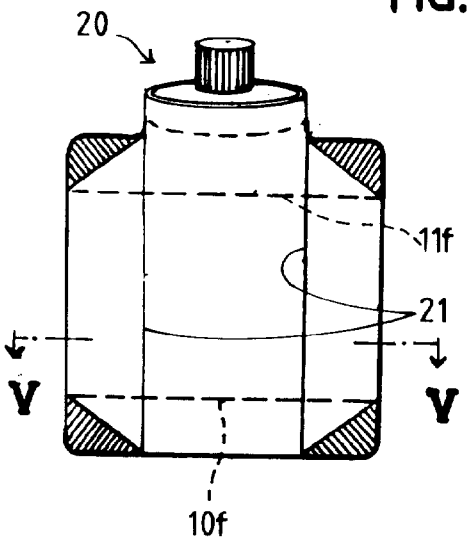
FIG. 2 shows a side view of the free-standing bag according to the present invention of FIG. 1.

The discharge opening 12 is formed by welding or heat-sealing the lid element flap and the side wall flap along the longitudinal edges thereof; as can be seen in FIG. 2, a screw plug element can be secured in position in said discharge opening 12 by means of heat-sealing. The resultant bag can, as a whole, be closed again, if it has not been emptied completely after having been used.

Figure 5:
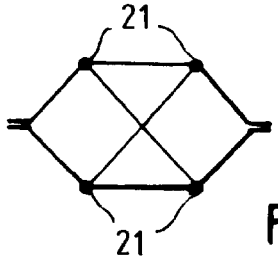
FIG. 5 shows a top view of a receptacle cut horizontally along line V—V and having the shape which the receptacle assumes in its filled state.

The side walls 2 and 3 are additionally provided with out-wardly directed longitudinal embossings 21 extending in spaced relationship with each other, as can be seen from FIG. 5.

Figure 3:
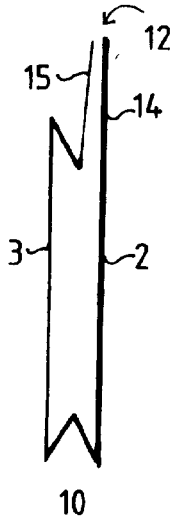
FIG. 3 shows a view of the free-standing bag cut longitudinally along line III—III of FIG. 1.
Figure 4:
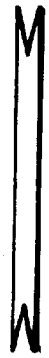
FIG. 4 shows a side view of the free-standing bag cut longitudinally along line IV—IV of FIG. 1.

These longitudinal embossings 21, two of which are realized in each side wall in the embodiment shown, have the effect that, when seen in a top view cut long the line V—V of FIG. 2, the filled bag assumes a shape of the type shown in FIG. 5. This hexagonal shape permits the bags to be arranged simply side by side without any dead space. FIGS. 3 and 4 show the respective longitudinally cut shapes of the free-standing bag in its assembled condition; these figures show that, at the point where the discharge opening 12 is formed, a removal passage extending along the whole side wall without any interruptions is formed so that pouring out can be performed in a very simple and uniform manner. As can be seen in FIG. 2, the bag according to this embodiment has an essentially square shape; for practical use, an edge length between 10 and 15 cm proved to be the edge length which should preferably be used.

Figure 6:
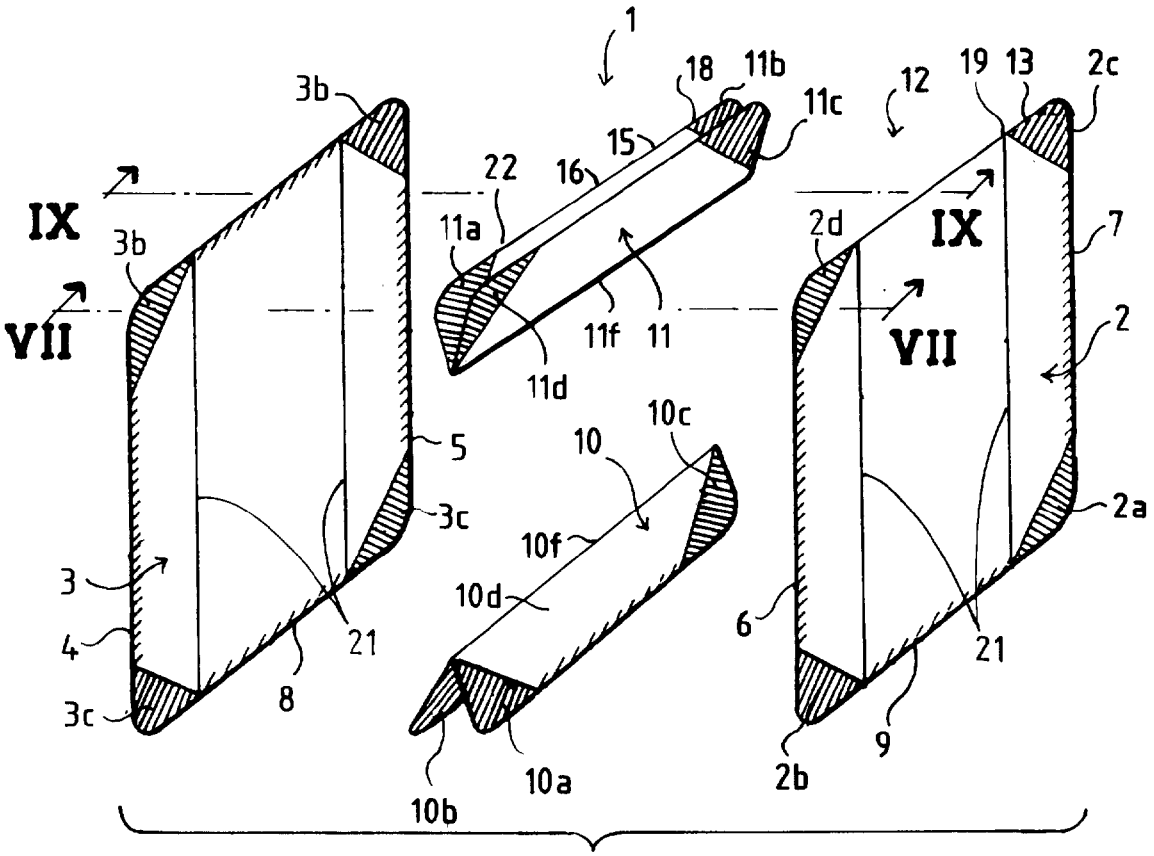
FIG. 6 shows a perspective exploded view of the component parts of a second embodiment of a free-standing bag according to the present invention.
Figure 7:
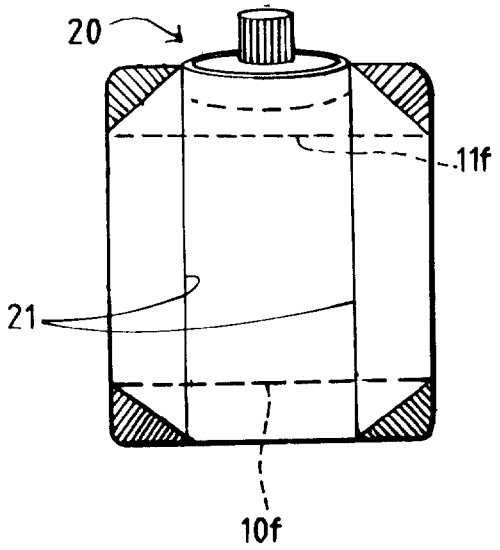
FIG. 7 shows a side view of the free-standing bag according to the present invention of FIG. 6.
Figure 8:
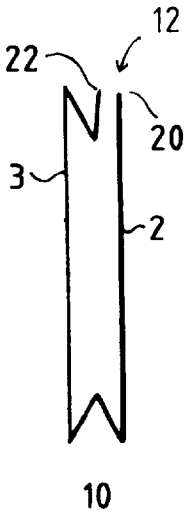
FIG. 8 shows a view of the free-standing bag cut longitudinally along line IX—IX of FIG. 6.
Figure 9:
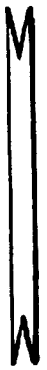
FIG. 9 shows a side view of the free-standing bag cut longitudinally along line VII—VII of FIG. 6.

FIGS. 6 and 9 show a second embodiment according to the present invention. Said second embodiment essentially corresponds to the first one, but it comprises neither a lid element flap 15 on the lid element 11 nor a corresponding side wall flap 14 for forming the discharge opening 12. In this embodiment, said discharge opening is formed between the upper transverse edge 20 of side wall 2 and the complementary lid element edge 22. As has already been described in connection with the preceding embodiment, the bag is heat-sealed, with the exception of the area of the discharge opening between the lid element and the side wall 2. As can be seen in FIG. 7, a screw plug element can be secured in position in said discharge opening 12 by means of heat-sealing. Of course, also this embodiment offers the possibility of providing, in the manner which has been described hereinbefore, an opening for filling the bag in the area of the bottom element.

It goes without saying that the rectangular shape of the lid element flap and the side wall flap according to the present embodiments can be replaced by other shapes; it is, for example, also possible to choose a tapering flap shape so as to obtain a "pouring spout".

What is claimed is:

1. In a free-standing bag made of a plastic foil and used for receiving therein liquids, comprising two side walls connected to each other along their longitudinal edges, a foldable bottom element, which is disposed between said side walls and which serves as a supporting base, being inserted between a bottom transverse edge of each of said side walls, whereas in an area at the top of said side walls a foldable lid element, which is disposed between said side walls, is inserted, and further comprising a discharge opening, which is formed between the upper transverse edge (13, 20) of one of said side walls (2) and the complementary edge (21, 22) of said lid element, the improvement comprising:

means for plugging said discharge opening being permanently secured within the discharge opening, the side walls (2, 3) being provided with outwardly directed longitudinal embossing (21) extending in spaced relationship with each other between the transverse edges and each side wall having corner areas which are interfacially connected to associated corner areas of the lid element and of the bottom element in a triangular shape.

2. In the free-standing bag according to claim 1, wherein the discharge opening is defined by a side wall flap, formed on one of said side walls and protecting beyond a transverse edge of said one of said side walls, and a lid element flap formed on the lid element in a corresponding manner, said side wall flap and said lid element flap being interconnected along their longitudinal edges.

3. In the free-standing bag according to claim 2, and including a side wall flap and a lid element flap, wherein said side wall flap and said lid element flap have an essentially rectangular shape.

4. In the free-standing bag according to claim 1 wherein said side wall flap (14) and said lid element flap (11) have an essentially rectangular shape.

5. The free-standing bag according to claim 1 or 2, said free-standing bag having an outer contour defining a square whose edges are between 10 and 15 cm long.

* * * * *

UNITED STATES PATENT AND TRADEMARK OFFICE

CERTIFICATE OF CORRECTION

PATENT NO. : 6,092,933

DATED : July 25, 2000

INVENTOR(S) : Wolfgang Treu

It is certified that error appears in the above-indentified patent and that said Letters Patent is hereby corrected as shown below:

Column 6, line 15, "and protecting beyond" should be —and projecting beyond—.

Signed and Sealed this

Tenth Day of April, 2001

*Attest:*

Nicholas P. Godici

NICHOLAS P. GODICI

*Attesting Officer*

*Acting Director of the United States Patent and Trademark Office*